US005090655A

United States Patent [19]

Bisson

[11] Patent Number: 5,090,655

[45] Date of Patent: Feb. 25, 1992

[54] SUPPORT FOR CHRISTMAS TREE

[76] Inventor: Marc-Antoine Bisson, 2397, rue Bellevue, St. Romuald Quebec, Canada

[21] Appl. No.: 675,948

[22] Filed: Mar. 27, 1991

[30] Foreign Application Priority Data

Apr. 4, 1990 [CA] Canada ..... 2013839

[51] Int. Cl.[5] ..... F16M 13/00

[52] U.S. Cl. ..... 248/523; 248/519

[58] Field of Search ..... 248/523, 519, 524, 527, 248/110

[56] References Cited

U.S. PATENT DOCUMENTS

| | | | |
|---|---|---|---|
| 893,247 | 7/1908 | Killerbrue . | |
| 982,866 | 1/1911 | Poppendieck . | |
| 2,448,304 | 8/1948 | Gabel | 248/48 |
| 2,455,404 | 12/1948 | Brown et al. | 248/524 X |
| 2,592,895 | 4/1952 | Harris | 248/523 |
| 2,840,331 | 6/1958 | Clifton | 248/523 |
| 2,938,304 | 5/1960 | Thomas et al. . | |
| 3,353,773 | 11/1967 | Budd . | |
| 3,403,877 | 10/1968 | Gudmundson . | |
| 3,469,342 | 9/1969 | Morris | 248/523 X |
| 4,074,461 | 2/1978 | Hirschman | 248/523 X |
| 4,190,983 | 3/1980 | Rostomily . | |
| 4,235,034 | 11/1980 | Black . | |
| 4,286,717 | 9/1981 | Liesinger | 248/110 X |
| 4,310,989 | 1/1982 | Shannon, Jr. | 248/523 X |
| 4,569,151 | 2/1986 | Hoffbeck | 248/519 X |
| 4,610,356 | 9/1986 | Porter et al. | 248/523 X |
| 4,901,971 | 2/1990 | Connelly | 248/523 |

*Primary Examiner*—J. Franklin Foss
*Attorney, Agent, or Firm*—Longacre & White

[57] ABSTRACT

The disclosure herein describes a support for engaging the trunk at the butt end of a cut tree and for holding upright the tree; it comprises a cylindrical body in which is positioned the butt end of the tree and which displays a transverse horizontal slot extending about half the cross section of the body. A U-shaped yoke has its intermediate straddle portion received in the slot and its two threaded leg portions extending along either side of the body and protruding through a pair of openings in a saddle member; a pair of nuts are used to tighten the U-shaped yoke and the saddle member so that the tree may be tightly secured in an upright position in the cylindrical body.

8 Claims, 1 Drawing Sheet

SUPPORT FOR CHRISTMAS TREE

FIELD OF THE INVENTION

The present invention relates to a support for engaging the trunk at the butt end of a cut tree, more particularly a Christmas tree, and for holding the tree upright.

BACKGROUND OF THE INVENTION

Christmas tree stands are known, such as described in U.S. Pat. No. 3,403,877 issued Oct. 1, 1968, to Gudmundson, U.S. Pat. No. 2,448,304 issued Aug. 31, 1948, to Gabel and U.S. Pat. No. 4,190,983 issued Mar. 4, 1980, to Rostomily.

In U.S. Pat. No. 3,403,877, a U-shaped yoke is used together with a saddle member for securing the butt end of a Christmas tree to a super structure rigidly connected to a broad base. In this type of tree stand, the butt end of the tree simply rests on the base thus allowing the tree to pivot or lose its upright position should it be accidentally tilted. In U.S. Pat. Nos. 2,448,304 and 4,190,983, the butt end of the Christmas tree is received within a cylindrical body; however, external means must be used to secure the trunk portion of the tree to the base.

Hence, the stands of the prior art provide precarious and unstable arrangements or require a complex securing arrangement.

OBJECTS AND STATEMENT OF THE INVENTION

It is an object of the present invention to provide a support for engaging the butt end of a cut tree and for holding upright the tree with a minimum of components.

This is achieved by using a minimum of parts which combine the features of simplicity and quickness of installation and assurance of an upright position of the tree once installed.

The present invention therefore relates to a support for engaging the trunk at the butt end of a cut tree and for holding upright the tree which comprises:

a cylindrical body adapted to receive the butt end of the cut tree therein, the body displaying a transverse horizontal slot extending for substantially half of the body;

trunk clamping means including a U-shaped yoke having an intermediate straddle portion extending in the slot and two leg portions extending along either side of the body in a direction opposite to the slot, the clamping means further including means forcing the straddle portion against the trunk to thereby securely abut the trunk against the inner wall of the body; and means at the bottom of the body for maintaining the body, with the tree secured therein, in an upright position.

In one form of the invention, the means at the bottom of the body consists of a base having a pair of elongated cross bars intersecting each other at mid-points thereof at right angles; the bars each have a first notch formed at mid-point for interlocking engagement one with the other.

In an other form of the invention, the means at the bottom of the cylindrical body consist of ground engaging tapered sections extending along the lower edge of the cylindrical body.

Other objects and further scope of applicability of the present invention will become apparent from the detailed description given hereinafter. It should be understood, however, that this detailed description, while indicating preferred embodiments of the invention, is given by way of illustration only, since various changes and modifications within the spirit and scope of the invention will become apparent to those skilled in the art.

IN THE DRAWINGS

FIG. 3 is a sectional view showing the yoke in the body slot; an

DESCRIPTION OF PREFERRED EMBODIMENTS

Figure 1:
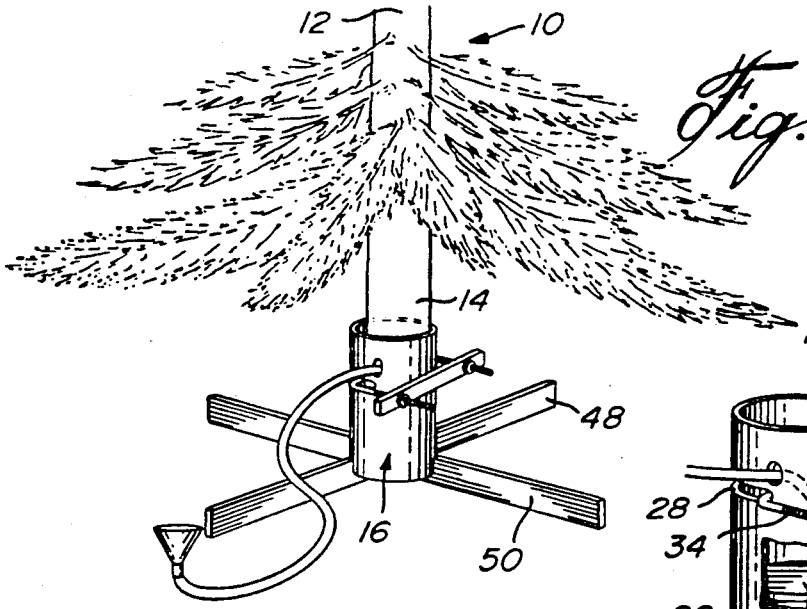
FIG. 1 is a perspective view of a tree support made in accordance with the present invention.

Referring to FIG. 1, there is shown a Christmas tree, generally denoted 10, having a trunk 12, the lower butt end 14 of which has been stripped of branches so that it may be placed vertically in a cylindrical body 16.

Figure 2:
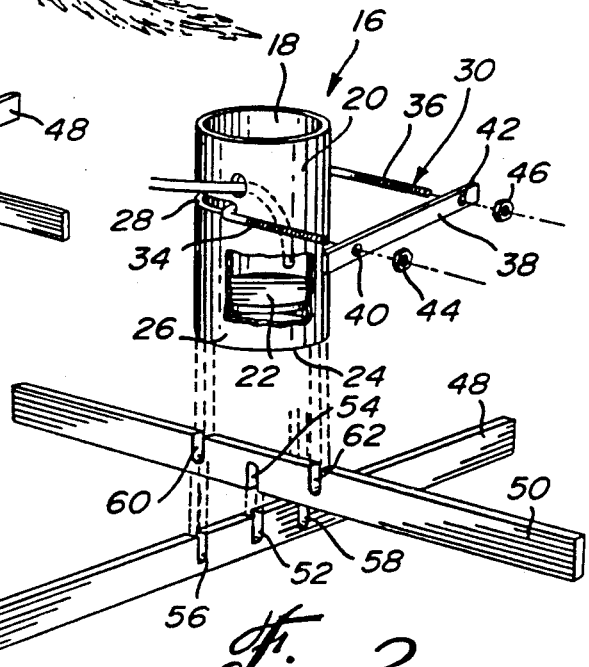
FIG. 2 is an exploded perspective view showing the various components of the support.

Referring to FIG. 2, the body 16 has an inner wall 18 and an outer wall 20. A bottom wall 22 extends horizontally above the lower edge 24 to thereby define a cylindrical flange 26.

Figure 3:
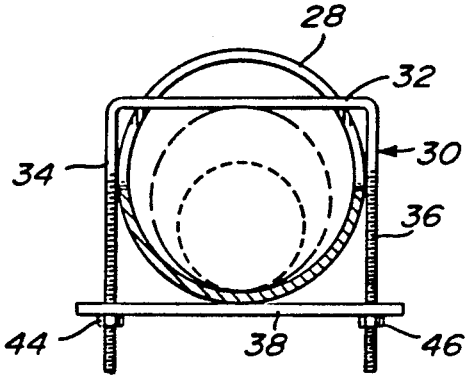

Referring also to FIG. 3, an important feature of the present invention is the provision of a slot 28 which extends horizontally for about half of the cross sectional distance of the body. A U-shaped yoke 30 is formed of a straddle portion 32 extending transversely in the slot and of two leg portions 34 and 36 extending along either side of body 16 in a direction opposite to the slot. A saddle member 38, in the form of a rectangular bar, has two openings 40 and 42 having a distance from one another corresponding to the distance separating the two leg portions 34 and 36 of the yoke member. A pair of nuts 44 and 46 are adapted to be threadedly engaged to the threaded portions of legs 34 and 36.

In the embodiment illustrated in FIGS. 1 and 2, the cylindrical body 16 is adapted to sit on a pair of cross bars 48 and 50. These cross bars intersect each other at mid-points thereof at right angles. Cross bars 48 and 50 each have a notch 52, 54 formed at mid-point for interlocking engagement one with the other. The cross bars further include notches 56 and 58, 60 and 62 which are adapted to receive therein the lower flange 26 of the cylindrical body. The gap of the notches should be such as to provide a tight fit when engaged with the lower flange.

As evidenced by the figures, the assembly of the cylindrical body 16 and the cross bars 48 and 50 may be quickly effected by a single person. The butt end 14 of a tree is positioned on base 22 and the tree stands substantially vertical in the cylindrical body. The yoke member 30 is inserted in the slot 28. With the aid of the saddle member 38 and the nuts 44 and 46, the trunk is forced by the straddle portion 32 of the yoke to abut against the inner cylindrical wall 18 of the body 16. In this position, the Christmas tree is secured upright as a result of a major portion of the trunk surface resting against the cylindrical inner wall of the body, as well as of the butt end resting on the bottom wall 22. Accidental contact on the tree causing pivotal movement of the tree and support, such as in the case of the stand described in U.S. Pat. No. 3,403,877, is prevented with the support of the present invention.

As an added feature, the walls of the cylindrical body 16 may be provided with an opening 64, thus allowing a hose 66 to direct water into the housing defined by walls 18, 20 and 22 of the cylindrical body.

Figure 4:
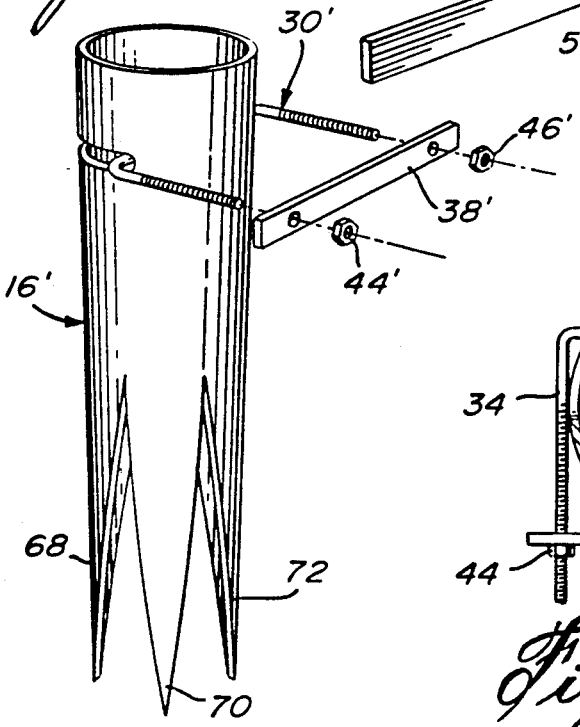
FIG. 4 is a perspective view showing another embodiment of a support made in accordance with the present invention.

Referring to FIG. 4, an other embodiment of the present invention is illustrated. The cylindrical body 16' is particularly adapted to engage the ground whenever a tree is to be supported outside a home. The upper part of the cylindrical body is structually identical to that of body 16 described above and cooperates with a yoke 30', saddle member 38' and nuts 44', 46' in a similar manner. In this embodiment, the lower part of the cylindrical body 16' is void of a bottom wall and includes a series of tapered sections 68, 70 and 72 which are forced into the ground to provide the required verticality of the tree to be supported. The mounting and securing of the tree trunk in body 16' is similar to that described above with respect to the embodiment illustrated in FIGS. 1 and 2.

Although the invention has been described above in relation to two specific forms, it will be evident to a person skilled in the art that it may be modified and refined in various ways. It is therefore wished to have it understood that the present invention should not be limited in interpretation, except by the terms of the following claims.

I claim:

1. A support for engaging a trunk at a butt end of a cut tree and for holding the tree upright, comprising:

a cylindrical body adapted to receive the butt end of the cut tree therein, said body having an inner wall and an outer wall and displaying a transverse horizontal slot extending for substantially half of said body;

trunk clamping means including a generally U-shaped yoke having an intermediate rectilinear straddle portion extending in said slot and two leg portions extending perpendicular to said straddle portion and along either side of said body in a direction away from said slot; said clamping means further including means forcing said straddle portion against said trunk whereby the trunk is secured to the inner wall of said body; and means at the bottom of said body for maintaining said body, with said tree secured therein, in an upright position.

2. A support as defined in claim 1, wherein said forcing means include a saddle member extending parallel to said straddle portion adapted to engage the leg portions of said U-shaped yoke.

3. A support as defined in claim 2, wherein said leg portions of said yoke have threaded portions adapted to protrude through corresponding openings in said saddle member; said forcing means further including nut means engaging the threaded portions of the protruding leg portions of said U-shaped yoke.

4. A support as defined in claim 1, wherein said means at the bottom of said body consists of a base having a pair of elongated cross bars intersecting each other at mid-points thereof at right angles; said cross bars each having a first notch formed at mid-point for interlocking engagement one with the other.

5. A support as defined in claim 4, wherein said cylindrical body includes a bottom wall and a lower flange below said bottom wall adapted to engage said cross bars.

6. A support as defined in claim 5, wherein each said cross bar has a pair of additional notches disposed on either side of said first notch at said mid-point; said lower flange of said body being engagedly received in said additional notches.

7. A support as defined in claim 5, further comprising an opening in said walls of said cylindrical body for receiving a hose connected to a water container whereby water may be directed within said cylindrical body.

8. A support as defined in claim 1, wherein said means at the bottom of said cylindrical body consist of ground engaging tapered sections extending along a lower edge of said cylindrical body.

* * * * *